US005281278A

United States Patent [19]

Stein

[11] Patent Number: 5,281,278

[45] Date of Patent: Jan. 25, 1994

[54] WIND TUNNEL FOR CLEANING AND CLASSIFYING SOLID PARTICLE FORM MATERIAL

[75] Inventor: Peter Stein, Caracas, Venezuela

[73] Assignee: Grana, Inc., New York, N.Y.

[21] Appl. No.: 872,603

[22] Filed: Apr. 23, 1992

[51] Int. Cl.[5] ..... B08B 5/00; B07B 4/00; B07B 7/00

[52] U.S. Cl. ..... 134/25.1; 209/141; 209/142

[58] Field of Search ..... 134/25.1; 209/140, 141, 209/142

[56] References Cited

U.S. PATENT DOCUMENTS

| | | | |
|---|---|---|---|
| 1,224,250 | 5/1917 | Adams | 209/1 |
| 1,846,184 | 2/1932 | Cleaver | 209/502 |
| 2,683,685 | 7/1954 | Matheson | 208/152 |
| 3,738,483 | 6/1973 | Mackenzie | 209/137 |
| 3,797,502 | 3/1974 | Reed et al. | 460/100 |
| 3,975,263 | 8/1976 | Elo | 209/154 |
| 4,127,476 | 11/1978 | Iannazzi | 209/138 |
| 4,523,682 | 6/1985 | Barmatz et al. | 209/638 |
| 4,946,044 | 8/1990 | Havrilla | 209/474 |

OTHER PUBLICATIONS

Brochure, Oliver Manufacturing Company, Hi-Cap Gravity Separators, including "Master Series" (date unknown).

Drawing Figure, New Generation 668-3-3 Product Flow, (date unknown).

*Primary Examiner*—Theodore Morris
*Assistant Examiner*—Zeinab El-Arini
*Attorney, Agent, or Firm*—Cooper & Dunham

[57] ABSTRACT

A chamber has upwardly diverging walls so that an upward airstream has different air speeds at different heights in the chamber. When particles such as seeds are put into the chamber, they reach equilibrium at different heights depending on their weights. A horizontal conveyor airstream, much less in magnitude than the upward airstream, directs the classified-by-height particles to a side wall of the chamber, where they are removed.

9 Claims, 3 Drawing Sheets

WIND TUNNEL FOR CLEANING AND CLASSIFYING SOLID PARTICLE FORM MATERIAL

BACKGROUND OF THE INVENTION

The present invention relates to a method or apparatus for cleaning and classifying solid particles having different sizes or weights, particularly seeds and grains.

There has always been a need to separate or classify material having solid particles of different sizes, weights, shapes or densities into various fractions.

In the processing of seeds, such as sesame seeds, it has been found that the impurity content of a crop delivered to a cleaning and processing plant is typically between 5 and 15%. The impurity content depends largely on climatic conditions during the corp. Good maintenance of the plantation and adequate storage in the farm contribute to lower content of impurities.

The composition by weight of the common impurities in a typical sesame seed harvest is as follows: seeds, 38.60%; leaves, 1.20%; stems, 50.80%; fibered particles 0.03%; earthy stones, 2.70%; grits, 0.24%; metallic particles, 0.09%; animal excrements, 2.30%; dead insects, 4.00%; and insect eggs, 0.04%.

One device used to remove impurities from seed crop is an airscreening cleaner. Such a device has a first stack of meshes arranged in parallel but inclined slightly to the horizontal. Material is deposited on the top mesh in the stack and has the largest mesh clearance, to collect the large impurities such as leaves and stems while allowing seeds and other smaller impurities to fall through the mesh. A second mesh beneath the top mesh has a medium mesh clearance and removes impurities in the same manner.

A lower mesh having a relatively small mesh clearance allows small impurities to fall through, while retaining the medium-sized material for further processing. The medium-sized material is then processed through a second stack of meshes having a closer range of mesh sizes.

Using such a machine, it has been found that the vegetable content of the impurities is about 90% of global impurity, the animal impurity about 7% of global impurity and the mineral content about 3% of global impurity. The mammal and insect excrement in the unclean material is typically about 2.3% of the global impurities, which is equivalent to about 1000 mg. (1 gram) of excrement per pound of seeds for averaged global impurities of about 10%.

The U.S.D.A. and A.S.T.A. (American Spice Trading Association) maximum tolerance of mammalian excrement in sesame seeds is only 5 mg./lb. While the U.S.D.A. and A.S.T.A. set a maximum foreign matter content of 0.5%, which is equivalent to 99.5% purity, the results indicate that in order to meet the required level of 1-5 mg./lb. of excrement/seed, a theoretical purity of 99.9% appears to be required. This would equate to reducing the trash or impurity content to 1% of its an initial content, a very difficult task.

One method of removing further impurities from seeds (after much of the impurities have been removed using an airscreening cleaner as described above) is by using a gravity table. Such devices claim to have a capacity of about 3500 lb./hr. for sesame seeds, no claim being made regarding purity. By feeding relatively clean material having an initial purity rate of 99.3-99.6% into such a cleaner, a final purity rate of 99.8% may be achieved. However, this rate is achieved after recycling the material one or two times, and at a capacity of only about 500-600 lb/.hr., much less than 3500 lb./hr. Such an arrangement would require many machines working both in series and in parallel (to avoid a bottleneck in production) to achieve an acceptable purity rate at a relatively high production capacity, requiring a high investment cost. Moreover, repeated recycling of the seed product results in mechanical fatigue of the seeds and grains, increasing the quantity of broken seeds/grains in the product and thereby actually resulting in an increase in impurity matter (the broken seeds) which must be removed. Thus recycling in an attempt to increase purity is in a sense counter productive. Further, the broken seeds often increase the acidity and cause the product to deteriorate.

There is thus a need to provide a cleaner and classifier arrangement which provides a high purity content of seeds and grains at a high capacity, with a limited investment.

SUMMARY OF THE INVENTION

According to the present invention, a method and apparatus for cleaning and classifying solid particles is provided.

Advantageously, the invention provides for superposition of two generally perpendicular airflows in a wind tunnel or chamber. The first airflow or airstream is a vertical suspension whose speed varies with height but whose speed is relatively constant or homogenous in any horizontal plane. This first airstream classifies the particles at different heights. The second airflow is a horizontal conveyor-stream acting to convey the classified particles horizontally to outlet channels where they are collected.

According to one form of the invention, an apparatus for cleaning and classifying solid particles having different weights is provided comprising a vertical chamber having a top, bottom and side walls, means for introducing particles of different weights into the chamber, means for creating a vertically upward suspension airstream in the chamber whose air speed varies with height, to thereby classify the particles by weight at different heights, a plurality of outlet channel means arranged vertically along the side wall of the chamber for removing particles classified by weight, and means for creating a horizontal conveyor airstream into the chamber to direct the suspended, classified particles toward the respective outlet channel means.

The vertical chamber preferably has a cross-sectional area which increases in the upward direction, so that the lighter particles are suspended at a height higher than the heavier particles. The apparatus preferably comprises a top converging section connected to the top of the vertical chamber and outlet means at the top of the converging section for collecting and removing particles lighter than particles suspended at the top of the vertical chamber. The vertical chamber preferably comprises four side walls comprising two generally parallel walls and two upwardly diverging walls connected to the parallel walls.

The cross-sectional area at the top of the chamber is preferably about two times the cross-sectional area at the bottom of the chamber, to thereby provide a vertical air speed at the bottom of the chamber about two times the vertical air speed at the top of the chamber.

The particles may be introduced into the chamber through an inlet at the bottom of the chamber. The means for creating a vertically upward airstream may comprise a suction fan in communication with the top of the chamber. The vertical airstream is preferably at least one order of magnitude greater than the horizontal airstream, and in one preferred form is about 40 times greater than the horizontal airstream.

The plurality of outlet channel means may comprise a plurality of outlet channels, e.g. eight in number, vertically arranged along the side wall of the vertical chamber, and outlet collectors connected to the respective outlet channels for collecting the classified particles. The particles which are classified may be seeds or grains.

The chamber preferably includes transparent windows in the side wall for observing the particles in the airstreams.

Means may be provided for adjusting the speed of the vertical airstream and for adjusting the speed of the horizontal airstream.

Collection means may be provided at the bottom of the vertical chamber in the form of downwardly diverging walls for collecting and removing relatively heavy particles which do not become suspended in the vertical airstream.

The top converging section may comprise a plurality of top converging subsections all of which are connected at their respective upper regions.

According to another aspect of the invention, a method for cleaning and classifying solid particles having different weights is provided, comprising introducing particles of different weights into a vertical chamber, creating a vertically upward airstream in the chamber whose air speed varies with height to thereby suspend the particles having different weights at different respective vertical heights, creating a horizontal airstream in the chamber for directing the suspended classified particles toward an inner side wall of said chamber, and removing the classified particles from the chamber at different vertical heights.

The vertical chamber preferably has an upwardly diverging cross-sectional area, so that the lighter particles are suspended higher than the heavier particles.

The method preferably includes further comprising providing a top converging section connected to the top of the chamber, and collecting and removing relatively light particles entering the top converging section.

The vertical airstream is preferably at least one order of magnitude greater than the horizontal airstream. The chamber preferably has a cross-sectional area at its top which is about twice the cross-sectional area at its bottom to provide an upwardly vertical air speed twice the speed at the chamber bottom than at the top. The particles may be seeds or grains.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DETAILED DESCRIPTION OF THE PREFERRED EMBODIMENT

Figure 1B:
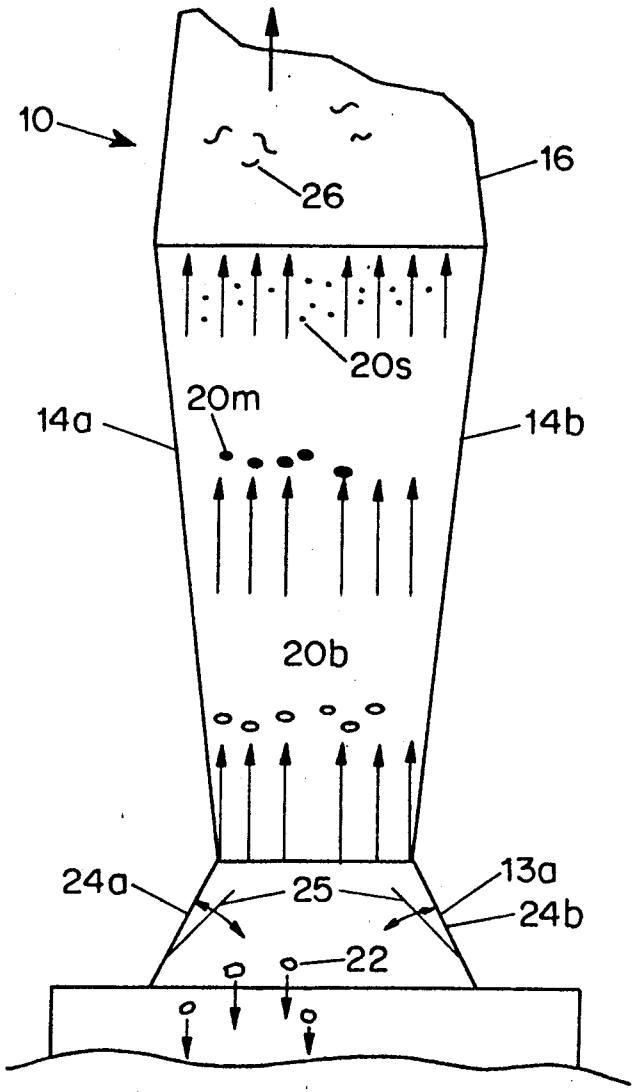
FIG. 1B is a side elevational view of the cleaner and classifier shown in FIG. 1A.
Figure 1A:
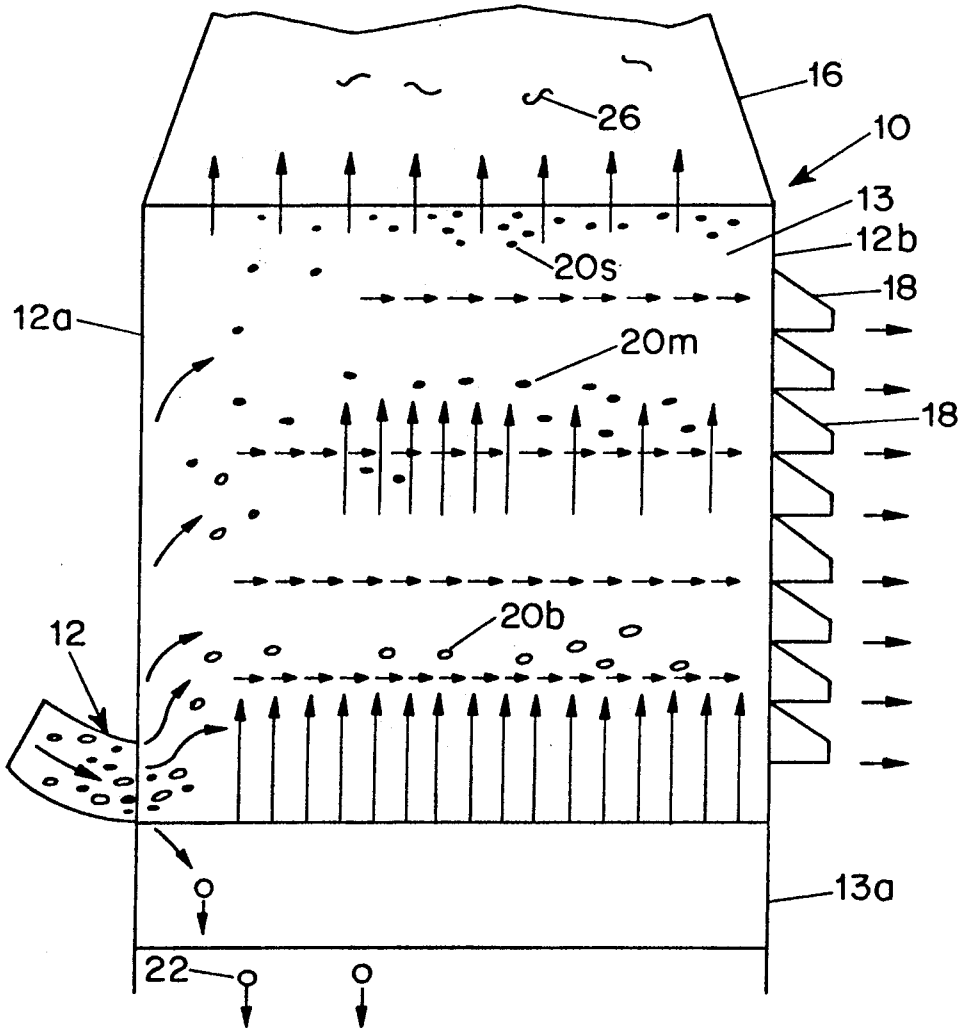
FIG. 1A is a front elevational view, in schematic form of a cleaner and classifier according to the invention.

The general concept of the invention will be described with reference to FIGS. 1A and B, which show, in schematic form, the concepts of the present invention. FIG. 1A shows a side view of a cleaner and classifier 10 according to the present invention, whereby an inlet 12 is shown at the bottom for providing solid particles, such as seeds, having different masses or weights. As shown in FIG. 1A, the chamber has generally parallel vertically oriented side walls 12*a* and 12*b*. However, as shown in FIG. 1B, a chamber 13 has upwardly diverging front and back walls 14*a* and 14*b*. At the top of the chamber 13, a top converging section 16 is provided connected to the top of the vertical chamber 13. As shown in FIG. 1A, a plurality of outlet channels 18, in this case 8, are provided along the side wall 12*b* of the chamber 13 for removing particles classified by mass or weight in a manner to be described below.

The device 10 includes means for creating a vertically upward suspension airstream as shown by the upward arrows in FIGS. 1A and 1B. The suspension stream is on the order of 10,000–20,000 cfm, the particular value depending on the type of seed, grain or particle. For sesame seeds, a stream of about 10,000 cfm. is believed to be acceptable. Due to the upwardly diverging front and back walls of the chamber 13, the magnitude of the upward air speed varies with height, to suspend the particles at different heights and classify them by mass or weight, with the lighter particles being suspended above the heavier particles. In the case where the particles are seeds, small seeds 20*s* will be suspended at the top of the chamber 13, medium seeds 20*m* at the middle and big seeds 20*b* floated at the bottom of the chamber 13. Heavier material 22 such as stones or other heavy debris will be removed at the bottom of the chamber 13 in section 13*a* by means of downwardly diverging walls 24*a* and 24*b* which arrangement serves to create an air speed which increases in the upward direction, whereby heavier materials such as the stones fall downward.

A pair of baffles 25 are provided at the bottom of the chamber. The baffles pivot as shown, and selection of their position will enable one to vary the ratio of the vertical air speed at the bottom of the chamber relative to the top of the chamber.

Due to the top converging section 16 at the top of the vertical chamber 13, relatively light debris 26 such as leaves and twigs will be pulled out of the top of the chamber 13 for disposal. Thus, the arrangement not only provides for the removal of relatively light debris 26 and relatively heavy debris 22 at the respective top 16 and bottom section 13*a* of the chamber, but also classifies the relatively small (20*s*), medium (20*m*) and big (20 *b*) mass or weight particles at the top, medium and bottom of the chamber, respectively.

Also provided is a means for creating a horizontal conveyor airstream in the chamber 13 for directing the suspended, classified particles horizontally toward the respective outlet channels 18. The conveyor airstream is much less than the suspension vertical stream, and is preferably on the order of 300 cfm, or about 3–5% of the vertical stream. The horizontal conveyor airstream will thus continually drive the vertically classified particles toward the outlet channels 18 where they are collected and removed.

Figure 2A:
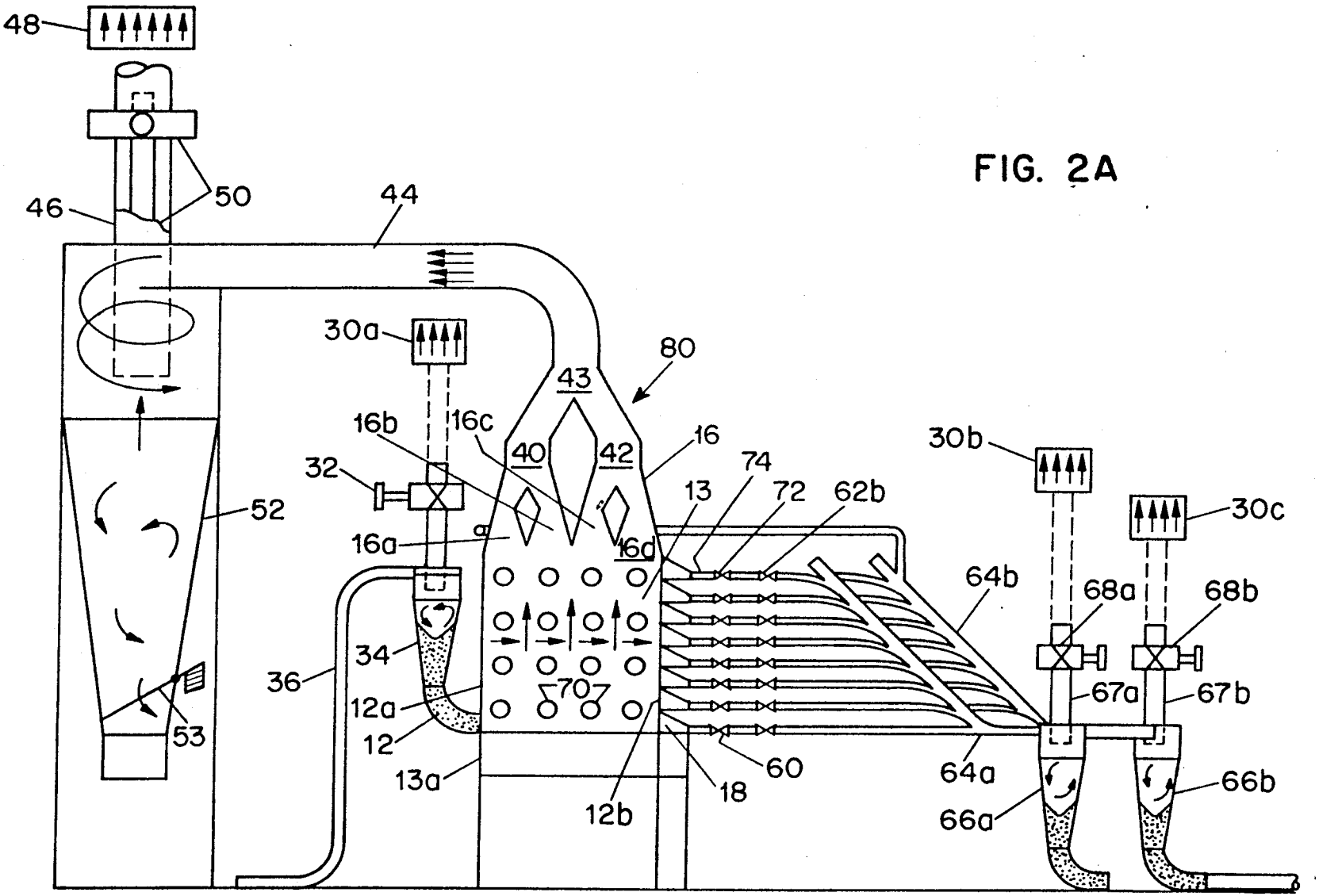
FIG. 2A is a front elevational view, in cross-section of a cleaner and classifier according to the invention.
Figure 2B:
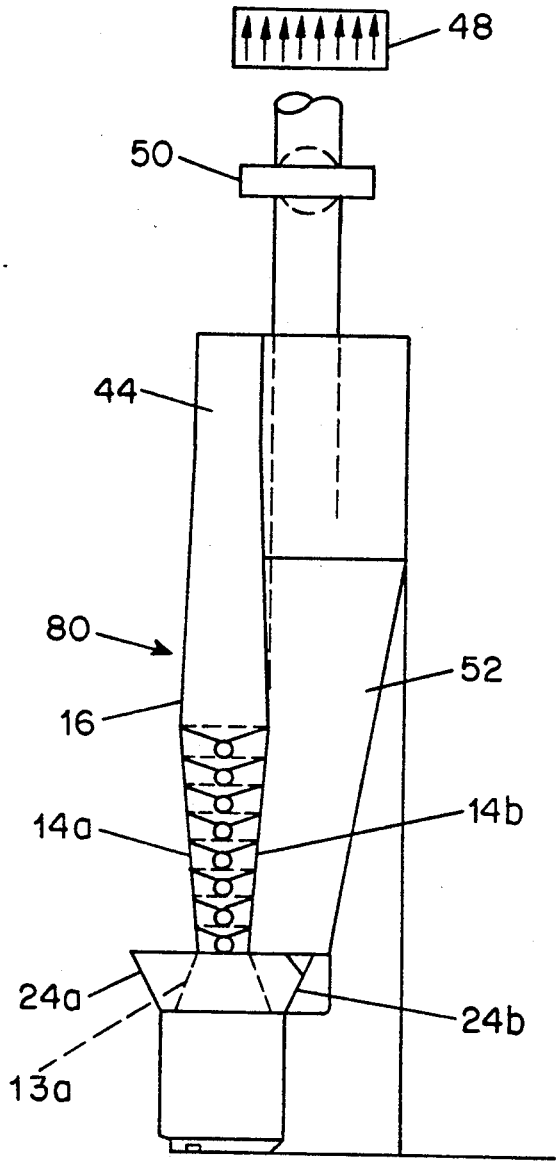
FIG. 2B is a side elevational view of the cleaner and classifier of FIG. 2A.
Figure 2C:
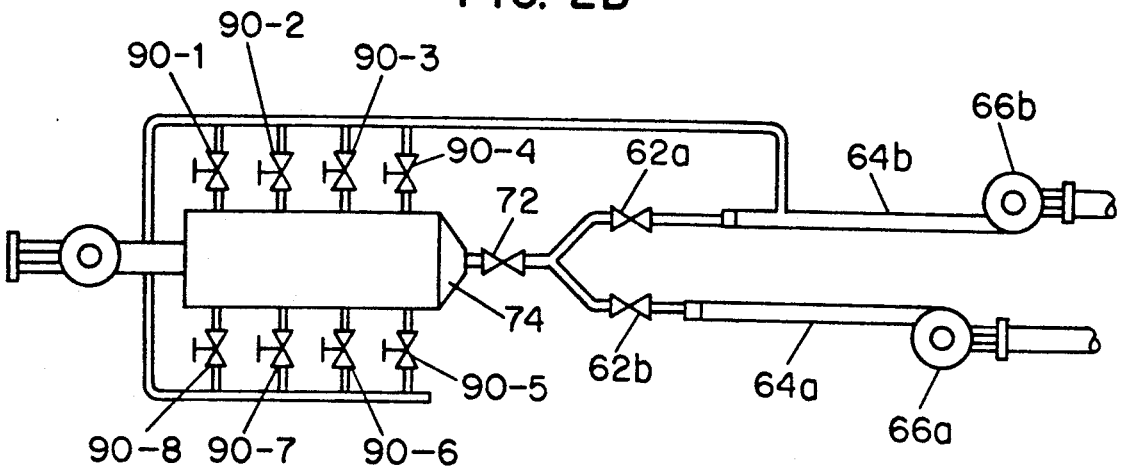
FIG. 2C is a top plan view of the cleaner and classifier of FIGS. 2A and 2B.

A more detailed illustration of the preferred embodiment according to the invention is shown in FIGS. 2A, 2B and 2C. As shown in FIG. 2A the cleaner and classifier according to the invention comprises a vertical chamber 13 having vertical parallel side walls 12*a* and 12*b*, but as shown in FIG. 2B, has upwardly diverging front and back walls 14*a* and 14*b*. The four walls together define a cross-section which increases in the upward direction. The cross-section at the top of the chamber 13 is about twice that at the bottom of the chamber 13. This ratio of about two to one in cross-sectioned area will encompass a large spectrum in seed size. Of course, the ratio may be made larger or smaller to increase or decrease the spectrum.

At the bottom of the chamber 13 is a particle material inlet means 12 for feeding particle material into the chamber 13. At the top of the inlet means 12 is a fan 30*a* having a flow rate of about 300 cfm which is connected through a control valve 32 to control the suction or the infeed rate of the material. It should be understood that the fan 30*a* is shown merely schematically at the position shown, and may be preferably mounted on the floor. The bottom of the inlet means is an inverted frustro-conical tube or cyclone member 34 which houses the particle material in the lower end, but because of the fan 30*a* has a cyclone airstream. Connected to this cyclone member 34 is a feed tube 36 for supplying the particle material to the inlet means 12. The fan 30*a* also serves to deliver the particle material from the feed tube 36 to the cyclone member 34.

Disposed at the top of the chamber 13 is a top converging section comprising four sub-sections 16*a*, 16*b*, 16*c* and 16*d*. The two leftmost subsections 16*a* and 16*b* are connected by a left union 40 and the two rightmost subsections 16*c* and 16*d* are connected by a right union 42. The two left subsections and left union are symmetrical to the two right subsections and union. A further Y-coupling 43 connects the left union 40 and right union 42 which communicates with an outlet tube 44. The outlet tube 44 is connected tangentially to a trash cyclone 52, so that the air entering the cyclone initially flows downward in the direction of the upper circular arrow, carrying with it the lighter debris 26. This debris collects at the bottom of the cyclone 52, where a weight regulated trap door 53 opens when enough debris accumulates to drop the debris out of the cyclone. The air exits the cyclone through a suction pipe 46 which at its upper end is connected to suction fan 48 having a 10,000–20,000 cfm capacity through a damper 50.

The suction fan 48, when the damper 50 is at least partially open, creates a suction or upward draft in the chamber 13 which floats the particle material according to mass or weight at different varying levels. This is because of the shape of the chamber 13 which has upwardly diverging walls 14*a* and 14*b* whereby the air speed at the bottom of the chamber is more than the air speed at the top of the chamber. The different mass or weight particles will thus float at different levels as described with reference to FIG. IA.

Means are provided for creating a horizontal conveyor stream which drives the classified floating particles horizontally towards the respective right side wall 12*b* of the chamber 13 as shown in FIG. 2A. Disposed at the right side of FIG. 2A is a plurality, in this case 8, outlet channels 18 which receive and collect the particle material at that particular vertical level. Each channel 18 has a respective regulating valve 60 and two switch valves 62*a* and 62*b* for connecting the respective channel to an A channel or a B channel pipe collector 64*a* and 64*b*. This is useful for diverting the particular particles in each respective channel after they have been inspected for grade or quality or the like. The outputs of the A and B channels 64*a* and 64*b* are then provided to respective outlet cyclones 66*a* and 66*b*. Rising upwardly from cyclones 66*a* and 66*b* are vertical pipes 67*a* and 67*b*, which are connected through respective control valves 68*a* and 68*b* to fans 30*b* and 30*c*, the fans being shown schematically. The fans 30*b* and 30*c* provide a means to create the horizontal conveyor airstream, and the respective control valves 68*a* and 68*b* enable one to regulate the conveyor air speed. Of course, the fans 30*b* and 30*c* may be located elsewhere, and may be actually one fan with fan 30*a*.

The chamber 13 further has watching windows 70 whereby an operator can observe the classification process and adjust the upward airstream and horizontal conveyor airstream by adjusting damper 50 and valves 68*a*, 68*b* and 60 to obtain the best classification results.

Although the invention is not limited thereto, the preferred embodiment may have a bottom width in the chamber 13 of about 0.4 meters, a top width of about 0.75 meters, and a speed ratio on the order of 1.9 or 2.0 (which is a ratio of the top width and bottom width). Hence, particles or seeds of different weight can be suspended and collected into the different channels 18.

Couplings 72 are also provided just after the channel end cones 74 for enabling an operator to physically inspect and sample the classified material to determine its grade and selecting either the A or the B channels 64*a* or 64*b*, by means of switching valves 68*a* and 68*b*.

Due to the nature of the upwardly converging top portion 16, once the lighter weight material or debris crosses over the boundary separating the main part of the chamber (having upwardly diverging walls) to the upper top portion 1*b* (having upwardly converging walls), the lighter material 26 will be accelerated through the symmetric roof section 30 out into the trash cyclone 52, thereby providing a cleaner grade of classified material. In a similar manner, the bottom downwardly diverging wall arrangement at the bottom section 13*a* of the chamber 13 serves to remove relatively heavy material 22 such as stones or the like.

The apparatus according to the invention will not only clean and classify the seeds or particles into eight categories (or more or less depending upon the number of channels desired) according to size, but it may also sort out seeds or particles of different color if the color difference is related to a difference in specific weight, size or shape. As can seen in FIG. 1A, the width of the chamber 13 is divided into four equal subsections corresponding to the subsections 16*a*, 16*b*, 16*c* and 16*d* of the top portion, whereby the same suction force or upstream flow is the same in all four subsections. Small discrepancies may be corrected for by means of four or more (in this case eight) valves 90-1 to 90-8. In this case two valves are provided for each subsection, but one or more than two may be provided for each subsection.

The turbulence of the vertical stream will cause the floating particles to be shaken up and down and laterally with an oscillating amplitude of perhaps one inch, more or less. This shaking or oscillation does not substantially adversely affect the classification, because the height of each channel is on the order of ten inches and the channel output is in any case checked before switching to grade A or grade B channels, 64*a* or 64*b*. In fact, the shaking may actually improve the cleaning performance.

The invention, as compared to a gravity separator, enables one to clean and classify seeds, grains or other particles with the same purity content, but at a larger capacity than the gravity separator, and without any need to recycle the seeds and thereby not subjecting them to mechanical stress causing broken seeds. The cost of an apparatus according to the invention may be much less than gravity separator arrangements.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A method for cleaning and classifying solid particles having different weights, comprising:

introducing particles of different weights into a vertical chamber;

creating a vertically upward airstream in the chamber whose air flow speed varies with height to thereby suspend the particles having different weights at different respective vertical heights;

creating a horizontal conveyor airstream in the chamber which is substantially continuous throughout the vertical extent of the chamber for directing the suspended classified particles toward a sidewall of said chamber; and removing the classified particles from the chamber at different vertical heights with a plurality of outlet channels.

2. The method according to claim 1, wherein the vertical chamber has an upwardly diverging cross-sectional area, and wherein the lighter particles are suspended higher than the heavier particles.

3. The method according to claim 1, further comprising providing a top converging section connected to the top of the chamber, and collecting and removing particles entering the top converging section.

4. The method according to claim 1, wherein the vertical airstream is at least one order of magnitude greater than the horizontal airstream.

5. The method according to claim 1, wherein the chamber has a cross-sectional area at its top which is about twice the cross-sectional area at its bottom to provide an upwardly vertical airspeed twice the speed at the chamber bottom than at the top.

6. The method according to claim 1, wherein the particles are seeds.

7. The method according to claim 1, wherein the length of the chamber in the direction of the horizontal airflow is substantially longer than the width of the chamber in a horizontal direction transverse to the horizontal airflow.

8. The method according to claim 1, wherein the horizontal and vertical airflow are created by suction to create a subatmospheric pressure in the chamber.

9. The method according to claim 1, further including the step of regulating the flow rate of the horizontal flow.

* * * * *